US007520787B2

(12) United States Patent
Waltz et al.

(10) Patent No.: US 7,520,787 B2
(45) Date of Patent: Apr. 21, 2009

(54) ELECTRICAL CONNECTION OF A CONTACT PIN TO A SHEET METAL COMPONENT

(75) Inventors: Eike Waltz, Aptos, CA (US); Werner Körber, Betzenstein (DE); Kurt Schaffer, Eckental (DE)

(73) Assignee: RITTAL RES Electronic Systems GmbH & Co. KG, Herborn (DE)

( * ) Notice: Subject to any disclaimer, the term of this patent is extended or adjusted under 35 U.S.C. 154(b) by 0 days.

(21) Appl. No.: 11/665,147

(22) PCT Filed: Oct. 21, 2005

(86) PCT No.: PCT/EP2005/011336

§ 371 (c)(1),
(2), (4) Date: Apr. 10, 2007

(87) PCT Pub. No.: WO2006/050804

PCT Pub. Date: May 18, 2006

(65) Prior Publication Data

US 2008/0096440 A1 Apr. 24, 2008

(30) Foreign Application Priority Data

Nov. 9, 2004 (DE) ..... 10 2004 054 310

(51) Int. Cl.
*H01R 4/48* (2006.01)

(52) U.S. Cl. ..... 439/816

(58) Field of Classification Search ..... 439/851, 439/787, 878, 842–843, 816, 877
See application file for complete search history.

(56) References Cited

U.S. PATENT DOCUMENTS

| | | | | |
|---|---|---|---|---|
| 2,391,425 | A | 12/1945 | Korn | |
| 3,120,418 | A | 2/1964 | Deakin | |
| 5,591,039 | A | 1/1997 | Matthews | |
| 6,062,919 | A | 5/2000 | Trafton | |
| 6,266,253 | B1 | 7/2001 | Kurrer et al. | |
| 6,848,922 | B2 * | 2/2005 | Coughlan et al. | 439/181 |
| 6,875,063 | B2 * | 4/2005 | Zhao et al. | 439/851 |

FOREIGN PATENT DOCUMENTS

| | | |
|---|---|---|
| DE | 578 727 | 6/1933 |
| DE | 36 34 462 A1 | 4/1988 |
| DE | G 92 17 337.3 | 5/1994 |
| DE | 198 07 555 C1 | 12/1999 |
| DE | 101 24 532 A1 | 10/2002 |
| EP | 1 379 115 A1 | 1/2004 |
| WO | WO 00/28799 | 5/2000 |

* cited by examiner

*Primary Examiner*—Edwin A. Leon
(74) *Attorney, Agent, or Firm*—Pauley Petersen & Erickson

(57) ABSTRACT

A device for detachable electrical connection of a contact pin to a sheet metal component. According to this invention, a durable conducting connection of the contact pin to the sheet metal component may be achieved, whereby the sheet metal component has at least one perforation, in which a sleeve for a contact element is housed in an electrically-conducting manner, enclosing a spring element. The contact pin is housed in the sleeve by the spring element in the assembled position and the contact pin and the sleeve are electrically connected to the sheet metal component by the spring element. This arrangement has a particularly high current-carrying capacity as a result of the spring arrangement housed in the sleeve.

16 Claims, 2 Drawing Sheets

ELECTRICAL CONNECTION OF A CONTACT PIN TO A SHEET METAL COMPONENT

BACKGROUND OF THE INVENTION

1. Field of the Invention

This invention relates to a device for a releasable electrical connection of a contact pin with a sheet metal component.

2. Discussion of Related Art

In most cases, sheet metal components, such as used as housing elements for electrical devices, require electrical contacts. In this context they are used, for example, as grounding contacts or electrostatic discharge (ESD) contacts. In this case the grounding contacts, in particular as a safety-relevant device, must be laid out for sufficiently high current strengths, along with a good electrical contact over the service life of the device. Many options are thus known, for example via screw connections, via screwed-on, soldered-on or welded-on plug-in connections, or via pressed-on or riveted-on contact elements. Most of these connections are used for the housing element with a cable.

The electrical connection of a front element, which is capable of electrically conducting, of an electrical printed circuit board with the guide rail and the transverse connecting rails of a component support by a centering contact element is described in PCT International Application WO 00/28799. In the publication, a structural system for electrical printed circuit boards is described for this purpose and has a component support with installation locations for inserting electrical printed circuit boards. Here, oppositely located transverse guide rails made of an electrically conducting material are used and receive with guide rails for the insertion of printed circuit boards into installation locations. The guide rails have a holding device for the reception of a receiving contact element made of an electrically conducting material, which can be brought into contact with a transverse connecting rail in a low-impedance manner. The receiving contact element has a contact area to which an electrically conducting front element can be connected. The front element has a centering contact element, which protrudes in a direction toward the insertion side of the component support which, when a front element is placed on an installation location, can be brought into contact with the contact area of the receiving contact element in an electrically low-impedance manner and with high current-carrying capability. In this case, it is possible to integrate a retaining spring into the receiving contact element as an additional contact means between the centering contact element and the receiving contact element.

Because of required structural elements, this system is very elaborate and cost-intensive in regard to the production of the components and the mounting of the elements. The complexly shaped receiving contact elements require cost-intensive special tools for their production, which permit a cost-effective manufacture only with very large numbers of pieces. Providing contacts for receiving systems for printed circuit boards, in which the bottom and cover elements already contain the guide rails for the special components, is not possible with the proposed system.

SUMMARY OF THE INVENTION

It is one object of this invention to provide a device of the type mentioned above but which permits a lasting electrical connection of a sheet metal component.

In order to make available a lasting conducting connection of the contact pin with the sheet metal component, the sheet metal component has at least one opening, in which a sleeve of a contact element is placed in an electrically conducting manner and which envelopes a spring element wherein, in the mounting position, the contact pin is received by the spring element in the sleeve, and the contact pin is connected in an electrically conducting manner with the sheet metal component via the spring element and the sleeve. The arrangement has a particularly high current-carrying ability because of the spring element arranged in the sleeve.

In one embodiment of the device, there is an improved protection against faulty mounting because the sleeve has a cylinder-shaped sleeve body and a detent at the front, and the opening in the sheet metal component has a corresponding diameter.

If a circumferential groove is provided between the detent and the sleeve body, and if the sleeve is connected with the sheet metal component by being pressed into the area having the groove, a lasting electrically connected, as well as a lasting secure seating of the sleeve in the sheet metal component, are achieved.

In a further embodiment of this invention, the sleeve is releasably connected with the sheet metal component, and thus the cylinder-shaped sleeve body has an exterior thread, and the sleeve is connected with the sheet metal component by a screw connection.

Dependable protection against a displacement of the spring element in case of a movement of the contact pin in the direction of the interior detent is achieved if the sleeve has two areas of different interior diameter, wherein the transition between the areas is formed as the interior detent of the spring element, and the spring element is arranged in the area of or near a greater interior diameter. It is thus possible to protect the spring element either against shifting during the introduction of the contact pin, or when the contact pin is pulled out.

If, following the spring element, a locking ring is provided on the side opposite the interior detent, the spring element is also protected against displacement in case of a movement of the contact pin away from the detent.

A particularly simple, yet non-positively connected embodiment of the locking ring provides for the locking ring to be designed as a longitudinally slit clamping sleeve.

If the sleeve has an interior diameter in the area of or near the locking ring which is widened in comparison with the area of the spring element, it is possible for the position of the locking ring to be precisely determined during mounting. It is also possible for the interior diameter of the locking ring to be selected so large that the contact pin can pass through the locking ring and so that its insertion length is not limited by the locking ring.

If the sheet metal component is a bottom element and/or a cover element, or a part of a bottom element and/or cover element of a component support, and if it has one or several openings on its front vertical edge for receiving one or several contact elements, it is possible to create a cost-efficient component support with which the sleeves are lastingly mechanically and electrically connected with the bottom element and/or the cover element.

If a position of the openings with the sleeves provided with spring elements corresponds to the position of the contact pins of front elements of printed circuit boards, which can be pushed into the component support, it is possible to produce a lasting electrically conducting connection of high current-carrying ability between the contact pins and the bottom elements and/or cover elements.

BRIEF DESCRIPTION OF THE DRAWINGS

This invention is explained in greater detail in view of an exemplary embodiment represented in the drawings, wherein.

DETAILED DESCRIPTION OF THE INVENTION

Figure 1:
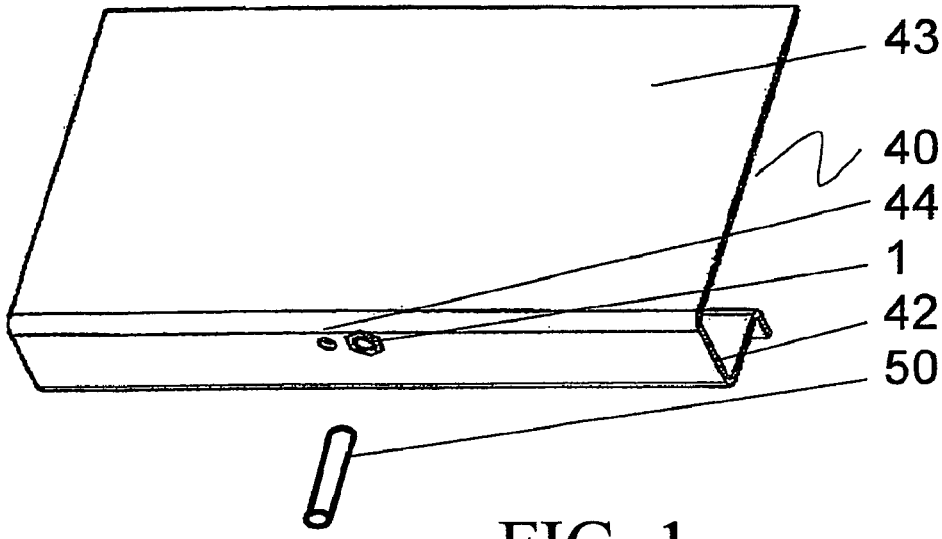
FIG. 1 is a perspective view of a sheet metal component with a contact element.

A sheet metal component 40 with a horizontal base 43, which makes a transition into a vertical edge 42, is shown in a perspective view in FIG. 1. Such a sheet metal component 40 can be used, for example, as the base plate of a receiving system for printed circuit boards in a component support. For this purpose, the base 43 has guide elements, not shown, for receiving the printed circuit boards.

A contact element 1, which can be engaged by a contact pin 50, is represented in the vertical edge 42. The contact pin 50 can be connected, for example, with a front plate of a printed circuit board, not shown, and can be pushed into the contact element 1 in the course of or during pushing the printed circuit board into the guidance device of the component support.

A bore 44 is represented next to the contact element 1. In it the element, for example the front plate of a printed circuit board on which the contact pin 50 is located, can be fixed in place by a screw.

Figure 2:
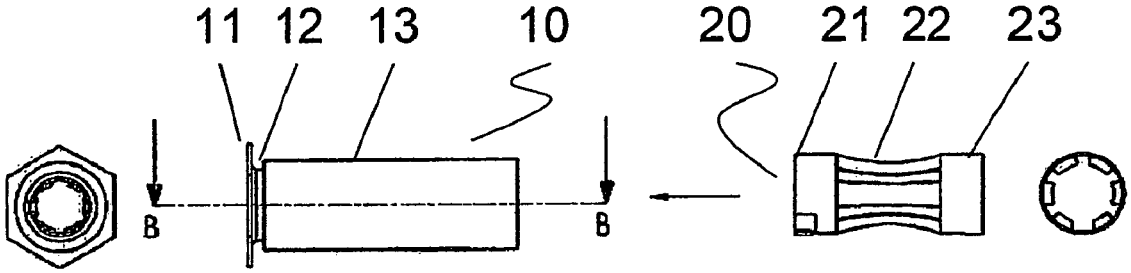
FIG. 2 is a lateral and front view of a sleeve and of a spring element of the contact element.

FIG. 2 shows the sleeve 10, as well as a spring element 20, in a lateral view and a front view. Here, the arrow shows the installation direction of the spring element 20 into the sleeve 10. The sleeve 10 includes a cylinder-shaped sleeve body 13, which makes a transition at the front into a detent 11 via a groove 12. The spring element 20 includes a front and a rear cylinder-shaped area 21, 22, as well as interspersed spring contact lamellas 22.

Figure 3:
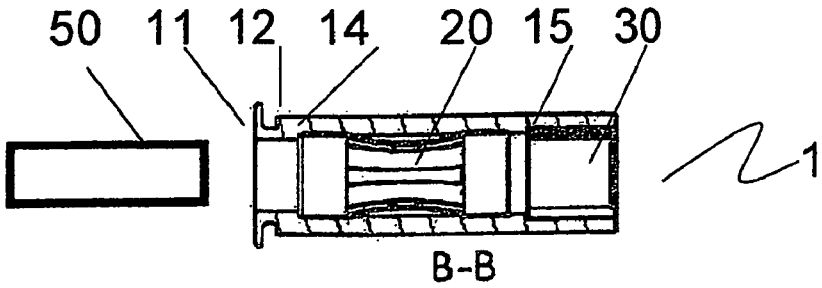
FIG. 3 is a longitudinal sectional view taken through the contact element with the spring element and the locking ring installed, as well as a prepositioned contact pin.

In FIG. 3, the assembly of the contact element 1 is shown as section line B-B in FIG. 2. In this case, the spring element 20 is completely pushed into the sleeve 10 and is secured at its end by a locking ring 30. For positioning the spring element 20 and the locking ring 30, the sleeve 10 has different interior diameters, wherein interior detents 14, 15 for the spring element 20 and the locking ring 30 are formed between the areas of different diameters. Thus, the spring element 20 is inserted for assembly from the side opposite the detent 11 into the sleeve 10 as far as the first interior detent 14. The locking ring 30 is subsequently inserted. Now, the contact pin 50 can be introduced into the contact element 1 from the front. In this case, the spring contact lamellas 22 provide good electrical contact with the contact pin 50. The locking ring 30 prevents the spring element 20 from being pushed out of the sleeve 10 during the introduction of the contact pin 50.

Figure 4:
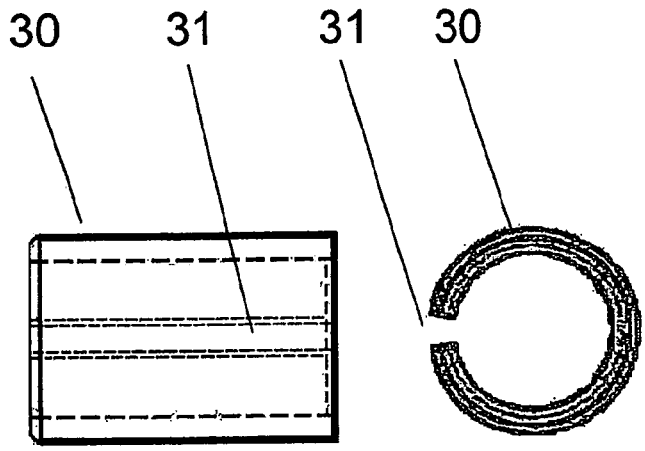
FIG. 4 is a lateral and front view of the locking ring represented in FIG. 3.

FIG. 4 shows a preferred embodiment of the locking ring 30. The locking ring 30 has a cylinder-shaped contour, wherein an exterior diameter is slightly larger than an interior diameter of the sleeve 10. The outer surface of the locking ring 30 has a longitudinal recess 31. When introducing the locking ring 30 into the sleeve 10, the locking ring 30 is compressed against its elasticity, the recess 31 is reduced. The locking ring 30 is non-positively maintained in the sleeve 10 by its elasticity.

Figure 5:
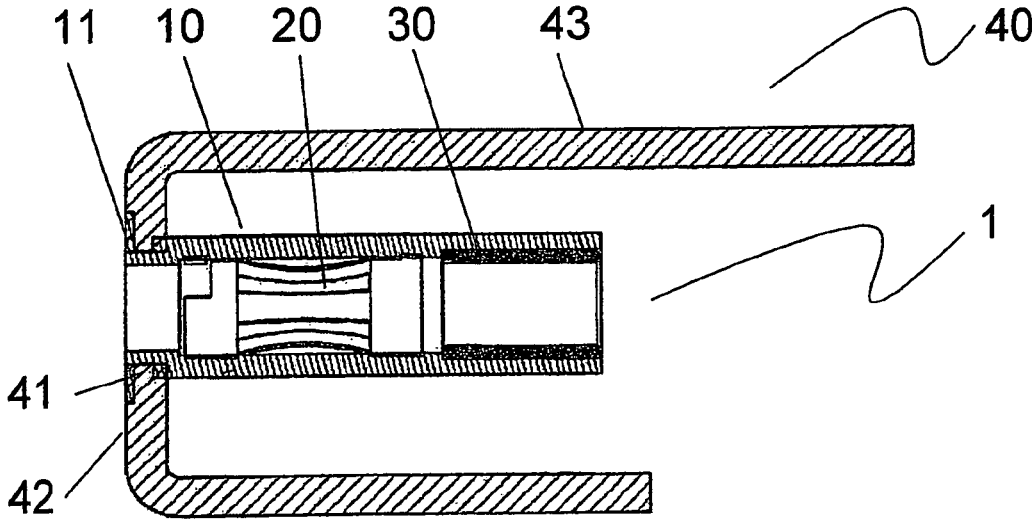
FIG. 5 is a longitudinal sectional view taken through the sheet metal component with the sleeve inserted.

FIG. 5 shows the sheet metal component 40 as shown in FIG. 1 in a lateral sectional view with a pressed in contact element 1. By pressing in, during which the contact element 1 is pushed from the front through the opening 41, a positive connection, started by cold forming, is created between the sheet metal component 40 and the sleeve 10. The sheet metal component 40 extends behind the detent 11 of the sleeve 10 in the area of the groove 12.

The invention claimed is:

1. A device for a releasable electrical connection of a contact pin with a sheet metal component, wherein the sheet metal component (40) has at least one opening (41), the device comprising:

a contact element (1) including a sleeve (10) placed in an electrically conducting manner in the opening (41), the sleeve (10) including an interior detent (14);

a spring element (20) enveloped by the sleeve (10) and adjacent the interior detent (14), wherein, in a mounting position, the contact pin (50) is received by the spring element (20) in the sleeve (10), and the contact pin (50) is connected in an electrically conducting manner with the sheet metal component (40) via the spring element (20) and the sleeve (10);

a locking ring (30) disposed within the sleeve (10) and disposed on a side of the spring element (20) that is opposite the interior detent (14), the locking ring (30) formed as a longitudinally slit clamping sleeve, and in an area of the locking ring (30) the sleeve (10) having an interior diameter which is widened in comparison with an area of the spring element (20).

2. The device in accordance with claim 1, wherein a circumferential groove (12) is between a detent (11) and a cylinder-shaped sleeve body (13), and the sleeve (1) is connected with the sheet metal component (40) and pressed into an area having the groove (12).

3. The device in accordance with claim 1, wherein a cylinder-shaped sleeve body (13) has an exterior thread, and the sleeve (10) is connected with the sheet metal component (40) by a screw connection.

4. The device in accordance with claim 1, wherein the sleeve (10) has two areas of different interior diameter, a transition between the areas is formed as the interior detent (14) of the spring element (20), and the spring element (20) is arranged near a greater interior diameter.

5. The device in accordance with claim 1, wherein one of the sheet metal component (40) is at least one of a bottom element and a cover element, and a part of at least one of a bottom element and a cover element of a component support and has at least one opening (41) on a front vertical edge (42) for receiving at least one contact element (1).

6. The device in accordance with claim 1, wherein a position of the openings (41) with the sleeves (10) with spring elements (20) corresponds to another position of the contact pins (50) of front elements of printed circuit boards, which can be pushed into the component support.

7. The device in accordance with claim 1, wherein the sleeve (10) has a cylinder-shaped sleeve body (13) and a detent (11) at the front, and the at least one opening (41) in the sheet metal component (40) has a corresponding diameter.

8. The device in accordance with claim 7, wherein a circumferential groove (12) is between the detent (11) and the sleeve body (13), and the sleeve (1) is connected with the sheet metal component (40) and pressed into an area having the groove (12).

9. The device in accordance with claim 7, wherein the cylinder-shaped sleeve body (13) has an exterior thread, and the sleeve (10) is connected with the sheet metal component (40) by a screw connection.

10. The device in accordance with claim 9, wherein the sleeve (10) has two areas of different interior diameter, a transition between the areas is formed as the interior detent (14) of the spring element (20), and the spring element (20) is arranged near a greater interior diameter.

11. The device in accordance with claim 10, wherein one of the sheet metal component (40) is at least one of a bottom element and a cover element, and a part of at least one of a bottom element and a cover element of a component support and has at least one opening (41) on a front vertical edge (42) for receiving at least one contact element (1).

12. The device in accordance with claim 11, wherein a position of the openings (41) with the sleeves (10) with spring elements (20) corresponds to another position of the contact pins (50) of front elements of printed circuit boards, which can be pushed into the component support.

13. A device for a releasable electrical connection of a contact pin with a sheet metal component, wherein the sheet metal component (40) has at least one opening (41), the device comprising:

a cylindrical shaped sleeve (10) including an exterior surface and an interior surface, wherein the exterior surface transitions to an exterior detent (11) via a groove (12) for connecting the sleeve (10) to the opening (41), and the interior surface includes a first opening at the exterior detent, a first diameter area and a second diameter area, wherein a first interior detent (14) is formed between the first opening and the first diameter area and a second interior detent (15) is formed between the first diameter area and the second diameter area;

a spring element (20) positioned within the first diameter area, wherein the contact pin (50) is received at the first opening and in, a mounting position, the contact pin (50) is received by the spring element (20) in the sleeve (10), and the contact pin (50) is connected in an electrically conducting manner with the sheet metal component (40) via the spring element (20) and the sleeve (10); and a locking ring (30) positioned within the second diameter area.

14. The device in accordance with claim 13, wherein a sheet metal component (40) is connected to the cylindrical shaped sleeve (10) by the groove (12).

15. The device in accordance with claim 13, wherein the cylinder-shaped sleeve (10) has an exterior thread, and the cylinder-shaped sleeve (10) is connected with a sheet metal component (40) by a screw connection.

16. The device in accordance with claim 13, wherein the locking ring includes an exterior diameter which is larger than a diameter of the second diameter area.

* * * * *